US009950913B2

(12) United States Patent
Zwifka et al.

(10) Patent No.: US 9,950,913 B2
(45) Date of Patent: Apr. 24, 2018

(54) CRANE AND SUPPORT UNIT FOR SUCH A CRANE

(71) Applicant: Terex Global GmbH, Schaffhausen (CH)

(72) Inventors: Martin Zwifka, Kirkel (DE); Benjamin Schaal, Zweibrücken (DE); Fritz-Botho Köster, Rockenhausen (DE)

(73) Assignee: TEREX GLOBAL GMBH, Schaffhausen (CH)

( * ) Notice: Subject to any disclaimer, the term of this patent is extended or adjusted under 35 U.S.C. 154(b) by 160 days.

(21) Appl. No.: 14/994,273

(22) Filed: Jan. 13, 2016

(65) Prior Publication Data

US 2016/0200556 A1 Jul. 14, 2016

(30) Foreign Application Priority Data

Jan. 13, 2015 (DE) ..... 10 2015 200 358

(51) Int. Cl.
*B66C 23/78* (2006.01)
*B66C 23/76* (2006.01)

(52) U.S. Cl.
CPC ..... *B66C 23/78* (2013.01); *B66C 23/76* (2013.01)

(58) Field of Classification Search
CPC ..... B66C 23/76; B66C 23/80; B66C 23/78
See application file for complete search history.

(56) References Cited

U.S. PATENT DOCUMENTS 752,248 A * 2/1904 Nickerson ..... B66C 23/76 212/197
2,526,613 A * 10/1950 Tanguy ..... B66C 23/74 212/198
3,398,967 A 8/1968 Brocklebank et al.
4,204,603 A * 5/1980 Ducreuzet ..... B66C 23/74 180/118
4,275,902 A 6/1981 Teja
4,280,627 A * 7/1981 Becker ..... B66C 23/36 212/197
4,349,115 A * 9/1982 Lampson ..... B66C 23/76 212/178
4,614,275 A * 9/1986 Zenno ..... B66C 23/36 212/195

(Continued)

FOREIGN PATENT DOCUMENTS

CN 201420266 Y 3/2010
CN 202465123 U 10/2012

(Continued)

OTHER PUBLICATIONS

European Search Report issued in European Application No. EP15193106, dated Jun. 10, 2016.

*Primary Examiner* — Emmanuel M Marcelo
(74) *Attorney, Agent, or Firm* — Browdy and Neimark, PLLC

(57) ABSTRACT

A crane comprises an undercarriage, an upper carriage arranged on the undercarriage, a rotary connection for rotatably mounting the upper carriage on the undercarriage about an axis of rotation, as well as a support unit attached to the upper carriage for increasing the distance of a tilting edge from the axis of rotation, so that the crane has an increased structural stability and an increased load capacity.

16 Claims, 9 Drawing Sheets

(56) References Cited

U.S. PATENT DOCUMENTS

| | | | | | |
|---|---|---|---|---|---|
| 4,711,358 | A * | 12/1987 | Konishi | B66C 23/74 | 212/178 |
| 4,716,729 | A * | 1/1988 | Kakeya | B66C 9/12 | 212/196 |
| 4,995,518 | A * | 2/1991 | McGhie | B66C 23/74 | 212/178 |
| 5,431,443 | A * | 7/1995 | Skoff | B60S 9/10 | 212/304 |
| 6,283,315 | B1 * | 9/2001 | Willim | B66C 23/76 | 212/196 |
| 6,499,611 | B1 | 12/2002 | Franzen et al. | | |
| 7,370,767 | B2 * | 5/2008 | Roodenburg | B66C 13/02 | 212/178 |
| 7,546,928 | B2 * | 6/2009 | Pech | B66C 23/76 | 212/196 |
| 7,766,176 | B2 * | 8/2010 | Pech | B66C 23/36 | 212/196 |
| 7,967,158 | B2 * | 6/2011 | Pech | B66C 23/76 | 212/178 |
| 8,162,160 | B2 * | 4/2012 | Zollondz | B66C 23/74 | 212/196 |
| 8,939,298 | B2 * | 1/2015 | Willim | B66C 23/74 | 212/178 |
| 9,102,507 | B2 * | 8/2015 | Willim | B66C 23/76 | |
| 9,278,834 | B2 * | 3/2016 | Pech | B66C 23/76 | |
| 2015/0210514 | A1 | 7/2015 | Albinger | | |

FOREIGN PATENT DOCUMENTS

| | | | | |
|---|---|---|---|---|
| DE | 3139853 | A1 * | 4/1983 | B66C 23/76 |
| DE | 9944927 | A1 | 3/2001 | |
| DE | 102011119655 | A1 | 5/2013 | |
| DE | 202014007894 | U1 | 10/2014 | |
| JP | S50150120 | A | 12/1975 | |
| JP | S5152413 | U | 4/1976 | |
| JP | S55161744 | U | 11/1980 | |
| JP | S6144498 | U | 3/1986 | |
| JP | 2010173756 | A | 8/2010 | |
| JP | 102020210 | A | 4/2011 | |
| JP | 2011-235978 | A | 11/2011 | |
| JP | 5617333 | B2 | 11/2014 | |

* cited by examiner

CRANE AND SUPPORT UNIT FOR SUCH A CRANE

CROSS-REFERENCES TO RELATED APPLICATIONS

This application claims the priority of German Patent Application, Serial No. 10 2015 200 358.2, filed Jan. 13, 2015, pursuant to 35 U.S.C. 119(a)-(d), the content of which is incorporated herein by reference in its entirety as if fully set forth herein.

FIELD OF THE INVENTION

The invention relates to a crane and a support unit for such a crane.

BACKGROUND OF THE INVENTION

DE 199 44 927 A1 discloses a crane with a jib, which is supported by means of a counter jib and a counterweight carriage.

U.S. Pat. No. 3,398,967 discloses a crane with a leveling device. U.S. Pat. No. 4,275,902 dis-closes a crane with an auxiliary support. DE 10 2011 119 655 A1 discloses a crane with an additional support.

SUMMARY OF THE INVENTION

An objective of the present invention is to create a crane in which the loading capacity is increased, in particular for the main jib operation, and/or which has improved structural stability, in particular in a direction opposite the main jib.

Said objective is achieved by a crane comprising a. an undercarriage, b. an upper carriage arranged on the undercarriage, c. a rotary connection for rotatably mounting the upper carriage on the undercarriage about an axis of rotation, d. a support unit attached to the upper carriage for increasing a distance of a tilting edge from the axis of rotation, so that the crane has an increased structural stability and an increased load capacity.

Said objective is further achieved with a support unit for a crane, which for increasing a distance of a tilting edge from the axis of rotation is attached to the upper carriage or is integrated into the upper carriage.

According to the invention it has been recognized that a support unit is able to increase the distance of a tilting edge of the crane from an axis of rotation. The tilting edge is a virtual line, which connects the support points of the crane. The connection of the tilting edges forms the standing area of the crane. As the distance of the tilting edge from the axis of rotation is increased, the standing area is increased. An increased standing area results in increased structural stability. In particular, a force created as a result of load shift can be compensated. A force of this kind needs to be taken into account by the dimensions of the structural stability for the crane. A backwards titling moment caused by said force is added to a moment which is created by an upper carriage weight. The sum of said moments can be compensated by the increased standing area. The increased standing area of the crane also means that it is possible to provide additional upper carriage counterweight, i.e. stacked onto the upper carriage. A deformation of the upper carriage as a result of the upper carriage counterweight causes an inclination of the upper carriage. A support unit, which at first is floating, i.e. arranged spaced apart from the ground, touches the ground as a result of the inclination of the upper carriage. The upper carriage with the upper carriage counterweight is supported on the ground. Because of the support of the deformed upper carriage it is possible to provide an additional upper carriage counterweight on the upper carriage which is supported by means of the support unit. The support unit thus makes it possible to stack up an increased amount of upper carriage counterweight, as a deformation of the upper carriage is intercepted by means of the upper carriage counterweight. In addition, this causes the increased distance of the tilting edge to the axis of rotation with the result that more upper carriage counterweight can be stacked and that the loading capacity of the crane is increased. The additional upper carriage counterweight increases a counter moment of the crane. In an uncomplicated manner the crane enables an increased structural stability and at the same time an increased loading capacity. In particular, the tilting of the crane is prevented when load shifts. In particular, the tilting of the crane is prevented during the setting up process by the upper carriage counterweight. In particular, the standing area of the crane is defined by the undercarriage, which is designed in particular to be rectangular. By increasing the distance of the tilting edge to the axis of rotation by means of the support unit the tilting edge is arranged outside the rectangular contour of the undercarriage, in particular along a direction of the longer side edges of the rectangular contour. The crane comprises an undercarriage and an upper carriage arranged thereon, which is mounted by means of a rotary connection rotatably about the axis of rotation on the undercarriage. The crane can also comprise a jib for lifting a load. The jib is secured in particular pivotably on the upper carriage. The jib can be pivoted in particular about a horizontally arranged jib pivot axis. The support unit is used in particular during the transport of the crane as a stabilizing element, for example on a low-loader. Additional support means are unnecessary. The crane is in a secured transport position. In particular, the crane according to the invention has advantages over a crane with a super lift mast for main jib bracing. In particular, the effort of setting up and transporting the super lift mast is unnecessary. Compared to a crane with a super lift mast the minimum pivot radius of the crane according to the invention is reduced. It is unnecessary to lengthen caterpillar tracks to form an increased support surface area. The lengthening of caterpillar tracks is expensive and takes up an increased amount of space on the building site. With the crane according to the invention also an increased central ballast is unnecessary. It is time-consuming to set up the central ballast, which is arranged in particular concentrically to the axis of rotation of the crane. The crane is in particular a mobile crane. The undercarriage can comprise a caterpillar chassis or a road chassis. Instead of a drivable undercarriage the crane can also comprise a non-drivable base or foundation, relative to which the upper carriage is arranged rotatably. The base or the foundation are also referred to as a pedestal. The crane can be a lattice boom crane or a telescopic crane.

A crane, in which the support unit comprises at least one support cylinder, allows direct support on the ground. It is possible to provide more than one support cylinder, in particular two support cylinders. The support cylinders are in particular arranged symmetrically to a central plane, which is oriented perpendicular to the rocking axis, about which a jib is articulated rockably on the crane. The total line of action of the support cylinder is arranged parallel to the central plane and in particular in the central plane. In this case its lateral stability relative to the central plane is increased. In particular, the crane has an increased lateral stability relative to a transverse load in a direction perpendicular to the rocking plane. It is also possible for the support cylinders to be arranged asymmetrically relative to the central plane. In each case, it is possible to attach the support cylinders adjustably on the crane relative to their distance from the central plane. For example, a linear guide is provided which is oriented perpendicularly to the central plane, i.e. parallel to the rocking axis, in particular horizontally. Different positions of the support cylinder relative to the central plane can be determined steplessly or by means of a defined grid.

In a crane, in which the support unit comprises a support element, in particular in the form of a support plate, the supporting effect, i.e. the support, is improved. The support force is reliably diverted into the ground. The support unit is supported reliably on the ground.

A crane, in which the support unit comprises a height adjusting element, makes it possible to adjust a vertical distance of the support unit from the ground. A height adjusting element is for example a hydraulic cylinder. It is also possible to have mechanical height adjusting elements such as for example a spindle drive, a rack drive or a shearing mechanism. Alternatively, also electrical or electronic height adjusting elements are possible in the form of a linear drive with an electric motor.

A crane, in which the support unit is arranged on the upper carriage relative to the axis of rotation opposite the jib, enables an advantageous compensation of the additional upper carriage counterweight. In particular, if a load shifts, causing a tilting moment to act on the crane, the load is advantageously intercepted. The arrangement of the support unit and jib opposite one another relative to the axis of rotation is achieved within the meaning of the invention for example if the jib is arranged at a front end of the upper carriage and the support unit is arranged at a rear end of the upper carriage opposite the front end. The front and rear end of the upper carriage are arranged in particular on the respectively shorter edge of a rectangular contour of the upper carriage in a plane perpendicular to the axis of rotation. The support unit, which comprises in particular exactly one support cylinder, can be arranged for example relative to the axis of rotation diametrically opposite the main jib on the upper carriage. In particular, if the support unit comprises a plurality of support cylinders, the support cylinders can be arranged at any angle to the rocking plane relative to the jib. The rocking plane is oriented perpendicular to a jib rocking axis. For example, the support cylinders are arranged at an angle to the rocking plane from the jib of 95° to 265°, in particular in an angular range of 105° to 255°, in particular in an angular range of 120° to 240°, in particular in an angular range of 135° to 225°, in particular in an angular range of 150° to 210° and in particular of 165° to 195°. In this arrangement the support unit in particular is arranged exclusively on the respectively shorter edge of the rectangular contour of the upper carriage. In particular, the support cylinders are arranged relative to the main jib on the upper carriage such that a resulting line of action of the vertical support is arranged diametrically opposite the jib. That is the case for example if precisely two support cylinders are provided which are arranged in mirror symmetry relative to the central plane. The support unit, in particular the support cylinders, can also be arranged alternatively or in addition on the respectively longer edges of the rectangular contour of the upper carriage. A connecting line of a respective support cylinder to the upper carriage is then oriented transversely, in particular perpendicularly, to the rocking plane. Such support units are used in particular for improving the lateral support of the upper carriage.

A crane, in which the support unit is secured directly to the upper carriage, enables uncomplicated and direct support. The crane is designed in an uncomplicated manner.

Alternatively, the support unit can be secured by means of an intermediate element, in particular in the form of an intermediate frame, onto the upper carriage. The support unit is secured in this case indirectly on the upper carriage. A flexible arrangement of the support unit is possible in this case.

A crane, in which the intermediate element is designed to be adjustable in length in a length adjusting direction, simplifies a flexible longitudinally adjusted arrangement of the intermediate element. The length adjusting device is oriented in particular parallel to a plane perpendicular to the axis of rotation. The length adjusting direction is in particular oriented parallel to the ground and in particular is oriented horizontally. In particular, the support unit is secured to the intermediate element. For designing the intermediate element to be adjustable in length a length adjusting drive is used in particular, which can be designed for example as a telescopic cylinder, a cable pull, a rack and pinion drive and/or a linear drive.

A crane, in which the support unit comprises a displacement element for displacing the support unit along the ground, makes it possible to move the crane with a support unit on the ground. In particular, more than one displacement element can be provided on the support unit. The displacement element is arranged to be rotatable about an, in particular horizontally oriented, axis of rotation and/or to be slidable relative to the ground on the support unit. The displacement element can be rotated in particular about an, in particular vertically oriented, longitudinal axis of a support cylinder. In addition, the displacement element can comprise a displacement element drive. The displacement element can be a wheel or a caterpillar or a support runner. The displacement element can also be designed as a sliding jaw.

A crane, in which the support unit is arranged dispaceably between a working position and a transport position on the upper carriage, enables a flexible and advantageous conversion from the working position to the transport position. In particular, the support unit is secured onto the upper carriage foldably, i.e. pivotably, in particular about a vertical pivot axis, by means of a folding mechanism.

A crane, in which the support unit is arranged in an unloaded state of the crane at a distance from the ground, enables a flexible manipulation of the crane, in particular the driving of the crane with a mounted support unit. At the same time a secure support is ensured on loading the upper carriage with an upper carriage counterweight. In particular, the distance of the support unit to the ground can be adjusted. The distance between support unit and ground in the unloaded state of the crane is a measurement of the reliable deformation of the upper carriage, from which there is an additional support of the upper carriage, i.e. of the crane, via the support unit on the ground.

A crane, in which a deformation of the upper carriage causes an inclination such that the support unit is supported on the ground, ensures a reliable support of the crane even with an additional upper carriage counterweight.

A crane with an, in particular adjustable, outer load, which when reached lifts the support unit from the ground, enables an increased counter moment in case of loading and at the same time a free rotatability of the upper carriage relative to the undercarriage.

A crane with an upper carriage counterweight arranged on the upper carriage allows an increase in the loading capacity. In particular, the upper carriage counterweight is arranged in a plane perpendicular to the axis of rotation between the axis of rotation and the support unit. In particular, the upper carriage counterweight, unlike a central ballast, is arranged offcentre relative to the axis of rotation. In particular, the upper carriage counterweight is arranged relative to the axis of rotation on the upper carriage such that it can exert a counter moment relative to a loading moment, which has been caused by an outer load on the jib. As the upper carriage counterweight is arranged displaceably in radial direction relative to the axis of rotation, the counter moment caused by the upper carriage can be adjusted variably. In particular, a drivable counterweight displacement unit is provided, in order to displace the upper carriage counterweight, in particular by automation, drivably relative to the axis of rotation. In particular, the upper carriage counterweight is arranged linearly displaceably on the upper carriage.

A support unit can be retrofitted as a retrofit unit on a crane. The support unit can be attached as a retrofittable support unit on the upper carriage. It is possible alternatively, to design the upper carriage itself as a retrofit unit, wherein the upper carriage can be retrofitted, in particular with an integrated support unit. In this way it is possible to convert the crane into a crane according to the invention. The resulting advantages for the support unit correspond to the advantages of the crane, referred to here.

A method for operating a crane comprises in particular the method steps of providing a crane with an undercarriage, an upper carriage arranged on the undercarriage, a rotary connection for rotatably mounting the upper carriage on the undercarriage about an axis of rotation and a support unit attached onto the upper carriage for increasing the distance of a tiling edge from the axis of rotation, so that the crane has an increased structural stability and an increased load capacity. Furthermore, the method step is provided that the crane is arranged in an unloaded state with the support unit at a distance from the ground other than from zero. Furthermore, the method step is provided that the crane is supported on the ground in case of loading, in particular on reaching a defined, in particular adjustable, load, in particular by supporting with a support element on the ground. Loading occurs for example during the shifting of load and/or during the setting up process of additional upper carriage counter weight.

Further advantages, features and details of the invention are explained in more detail in the following for example embodiments with reference to the drawing.

DESCRIPTION OF THE PREFERRED EMBODIMENTS

Figure 1:
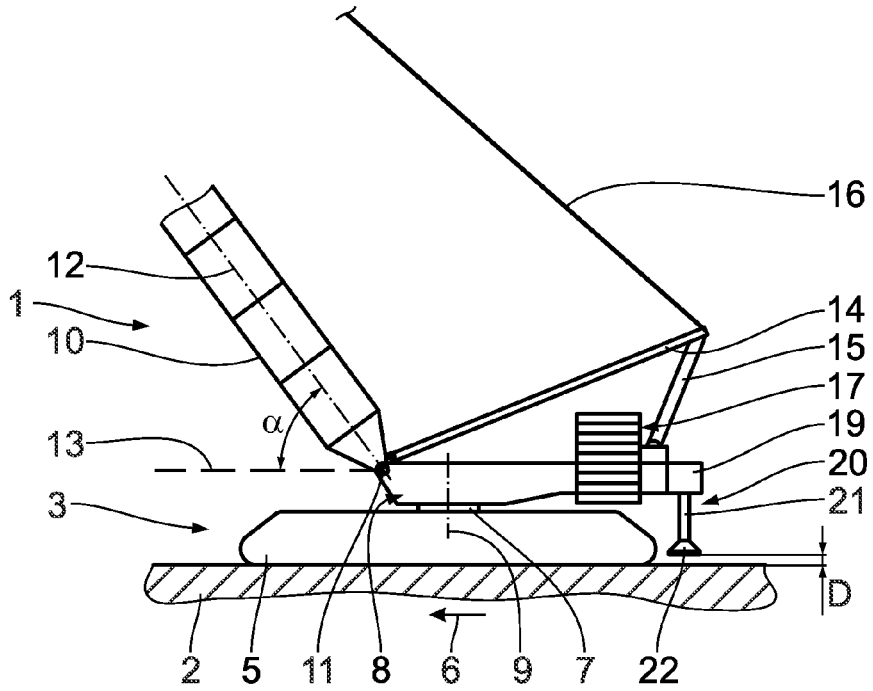
FIG. 1 shows a schematic side view of a crane according to the invention with a support unit.
Figure 2:
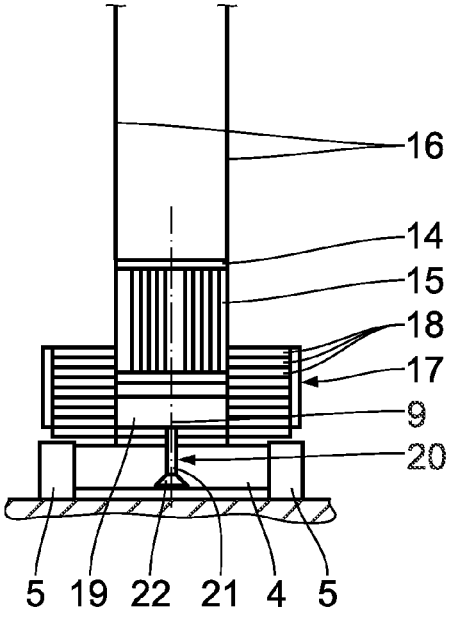
FIG. 2 shows a view from the rear of the crane according to FIG. 1.

A crane 1 shown schematically in FIGS. 1 and 2 is a mobile crane. The crane 1 can be driven on the ground 2. Furthermore, the crane 1 comprises a drivable undercarriage 3, which according to the shown embodiment comprises a middle part 4 and caterpillar supports 5 attached on both sides. The caterpillar chassis 5 determine a direction of travel 6. According to FIG. 1 the direction of travel 6 is aligned horizontally from right to left. Instead of the caterpillar chassis 5 a road chassis can also be provided for driving the crane 1.

By means of a rotary connection 7 on the undercarriage 3 an upper carriage 8 can be mounted rotatably. The rotary connection 7 defines an axis of rotation 9, about which the upper carriage 8 can be rotated. The axis of rotation 9 is oriented perpendicular to the ground 2 and in particular aligned vertically.

On the upper carriage 8 a jib 10 is hinged pivotably about a jib pivot axis 11. The jib pivot axis 11 is oriented perpendicular to the axis of rotation 9 and perpendicular to the direction of travel 6. The jib pivot axis 11 is oriented in particular horizontally. The jib 10 comprises a jib longitudinal axis 12, which is pivoted relative to the horizontal 13 about a rocking angle $\alpha$. According to the shown example embodiment the rocking angle $\alpha$ is about 45°. Typically the rocking angle $\alpha$ is between −20° and 90°. In the negative angle range between −20° and 0° the jib 10 is situated below the horizontal 13, i.e. between the ground and the horizontal 13. This is the case for example at the beginning of a setting up process.

The rocking angle $\alpha$ is joined by a bracing angle which is formed between the jib longitudinal axis 12 and a bracing gantry 14. Said bracing angle according to the shown embodiment is about 120°. The sum of the rocking angle and bracing angle can in the shown crane 1 be in an angular range of −20° to 180°.

On the upper carriage 8 a bracing gantry 14 is also provided which is used by means of a retractable working cable 15 and a main jib brace 16 for bracing the jib 10. The jib 10 is a main jib. The main jib bracings 16 are designed as bracing cables and engage with a not shown tip of the jib 10.

On the upper carriage 8 an upper carriage counterweight 17 is arranged. The upper carriage counterweight 17 comprises a plurality of counterweight plates 18, which are arranged stacked on top of one another on the upper carriage 8. For reasons of space and/or stability, as shown in FIG. 2, two stacks of counterweight plates 18 can be arranged on the edge above the middle part 4 of the undercarriage 3. The upper carriage counterweight 17 is arranged offset along the direction of travel 6 relative to the axis of rotation 9. In particular, the upper carriage counterweight 17 is arranged along the direction of travel 6 behind the axis of rotation 9. The upper carriage counterweight 17 is arranged along the direction of travel 6 in a rear section of the upper carriage 8.

The jib pivot axis 11 is arranged in a front section of the upper carriage 8. The upper carriage 8 has a rectangular contour oriented perpendicular to the axis of rotation 9, wherein the two shorter edges of the rectangle are oriented parallel to the jib pivot axis 11 and the two longer edges of the rectangle are oriented parallel to the direction of travel 6.

A weight force created by the upper carriage counterweight 17 causes a counter moment relative to the rotary connection 7, which acts against a load moment created by the jib 10 with a possibly attached load.

In a rear section of the upper carriage 8 oriented along the direction of travel 6 an intermediate element 19 is arranged. The intermediate element 19 is designed as a supplementary frame. The intermediate element 19 is secured directly onto the upper carriage 8. A support unit 20 is secured onto the intermediate element 19. The support unit 20 is secured by means of the intermediate element 19 indirectly onto the upper carriage 8. The support unit 20 comprises a support cylinder 21, which as a hydraulic cylinder is designed as a height adjusting element. On a lower side of the support cylinder 21 a support element is provided in the form of a support plate 22.

In the arrangement shown in FIG. 1 the crane 1 is in an unloaded state, i.e. there is no load on the jib 10. In this unloaded state the support unit 20 is arranged in a floating manner on the upper carriage 8. This means that the support unit 20 is arranged at a distance D relative to the ground. The support unit 20 can also be arranged on the ground. In this case the distance D is equal to zero. The size of the determinable distance D is in particular dependent on the number of positioned counterweight plates, i.e. on the size of the weight force created by the upper carriage counterweight 17, which causes the bending of the upper carriage 8. In addition, the distance D can be adjusted in a length-adjustable embodiment of a support cylinder 21. It is also possible that the support unit 20 is designed to be permanently in contact with the ground.

The support unit 20 comprises precisely one support cylinder 21, which is arranged centrally with respect to the width direction of the crane 1 on the intermediate element 19. The support cylinder 21 and in particular the support unit 20 are arranged symmetrically relative to a central plane of the crane 1. The central plane is oriented vertically and includes the axis of rotation 9.

Figure 3:
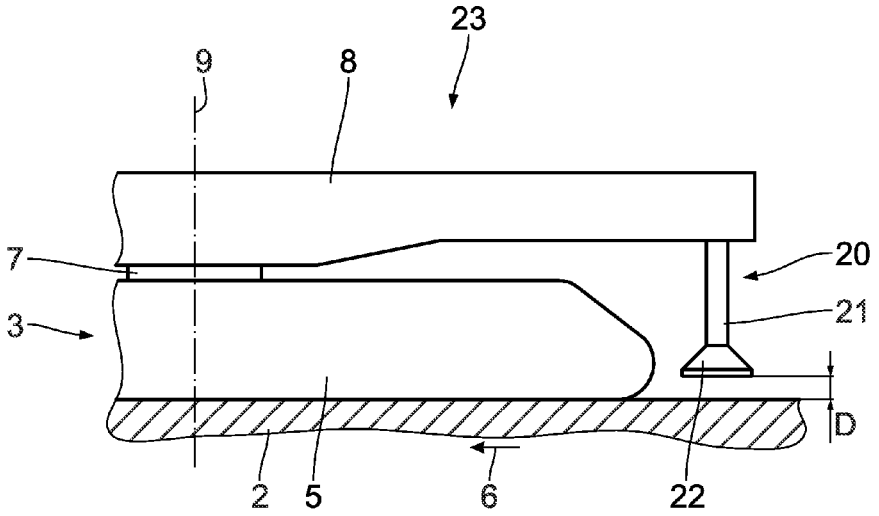
FIG. 3 shows an enlarged detailed view according to FIG. 1 of a crane of a further embodiment.
Figure 4:
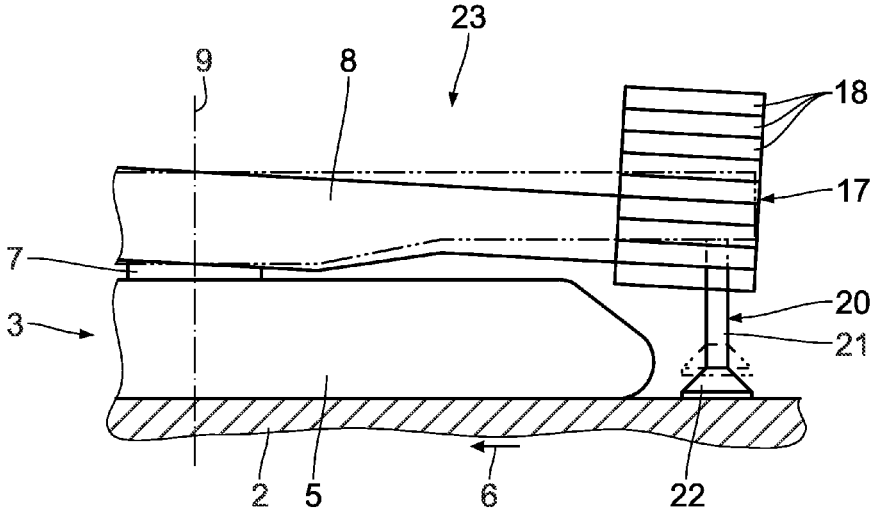
FIG. 4 shows a view of the crane according to FIG. 3 additionally with an additional upper carriage counterweight.
Figure 5:
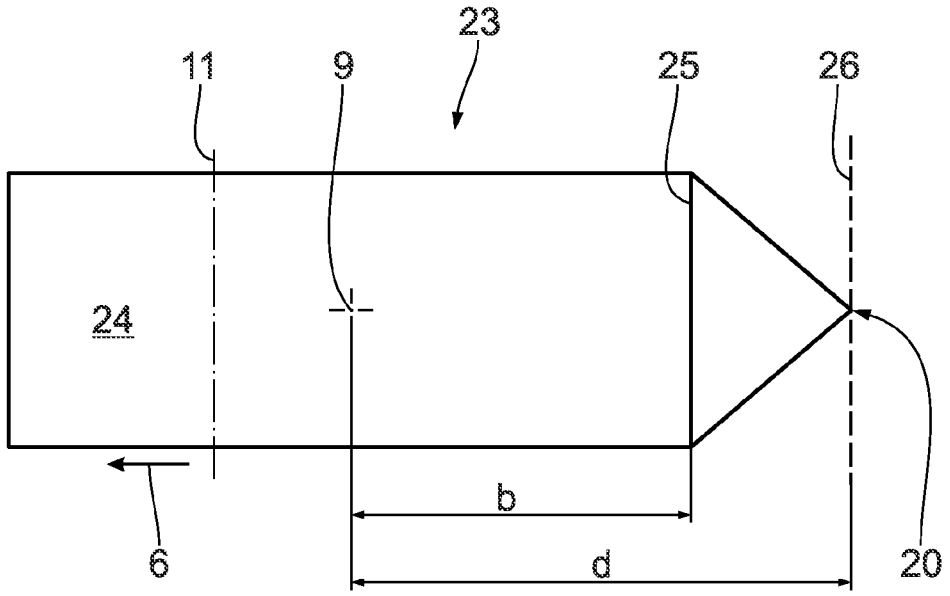
FIG. 5 shows a schematic representation of a standing area of the mobile crane in FIG. 4.

A further embodiment of the invention is shown in FIGS. 3 to 5. Components, which correspond to those already explained above with reference to FIGS. 1 and 2, have the same reference numerals and are not discussed again in detail.

For the crane 23 shown schematically in FIG. 3 various functional components have been omitted purely for illustrative reasons. This relates for example to the jib itself and the bracing for the jib. Also the upper carriage counterweight is not shown, which can generally be premounted on the upper carriage 8, in particular also in an unloaded state of the crane 23 shown in FIG. 3. The main difference in the crane 23 from the previous embodiment is that the support unit 20 is secured directly onto the upper carriage 8. An intermediate element is unnecessary.

A loaded state of the crane 23 is shown in FIG. 4. Loading can be performed for example by applying an upper carriage counterweight 17. The upper carriage counterweight 17 is arranged off-centre relative to the rotary connection 7. The upper carriage counterweight 17 causes a counter moment. The weight force of the upper carriage counterweight 17 causes the deformation of the upper carriage 8. The deformation of the upper carriage 8 is shown in FIG. 4 by a solid line. The original, undeformed contour of the upper carriage 8 is shown by dashed lines in FIG. 4. The deformation of the upper carriage 8 causes the support unit 20 with the support plate 22 to be pushed downwards to the ground 2. On achieving a variably adjustable load for the upper carriage counterweight 17 the deformation of the upper carriage 8 is so great that the support unit 20 with the support plate 20 rests on the ground 2. In this state there is an additional support for the crane 23 by the support unit 20.

The resulting support surface 24 is shown schematically in FIG. 5. The support surface 24 is designed to be rectangular and is a result of the size and arrangement of the caterpillar chassis 5. The axis of rotation 9 is arranged centrally within the rectangular support surface 24. The axis of rotation 9 can also be arranged off-centre relative to the rectangular support surface 24. The jib pivot axis 11 is arranged in the direction of travel 6 in front of the axis of rotation 9. Opposite the direction of travel 6 behind an rear end of the rectangular support surface 24 the support unit 20 is arranged. As soon as the crane 23 is loaded, as shown in FIG. 4, there is additional support for the crane 23 with the support unit 20. In this way the original, rear tilting edge 25 arranged at an original distance b from the axis of rotation 9 is displaced to the rear opposite the direction of travel 6. The new, rearwards displaced tilting edge 26 intersects the support unit 20. By means of the support unit 20 the distance d of the new tilting edge 26 from the axis of rotation 9 increases. Thus: $d>b$.

In the following the functioning of the crane 23 according to the invention is explained in more detail. On the basis of an unloaded state according to FIG. 3, in which not shown upper carriage counterweights can be provided as the main ballast, the crane is loaded for example in that an additional upper carriage counterweight 17 shown in FIG. 4 is arranged on the upper carriage 8. The additional upper carriage counterweight 17 causes a deformation of the upper carriage 8. Said deformation can be tolerated by means of the support unit 20 and supported in that the upper carriage 8 is deformed such that the support unit 20 rests on the ground 8. The crane is additionally supported by the support unit 20. As an additional upper carriage counterweight 17 is allowed, the upper carriage 8 enables an increased counter moment, which results in an increase in the load bearing of the crane 23. As already explained with reference to FIG. 5, the upper carriage 23 also has an increased support area, in that the rear tilting edge is arranged at an increased distance d from the axis of rotation 9. The support unit 20 also ensures a rearwards directed dynamic if a load shifts, which is added to the counter moment caused by the upper carriage counterweight 17. The sum of said two rearwards directed counter moments is intercepted by the support unit 20 on the upper carriage 8. The structural stability of the crane 23 is increased.

Figure 6:
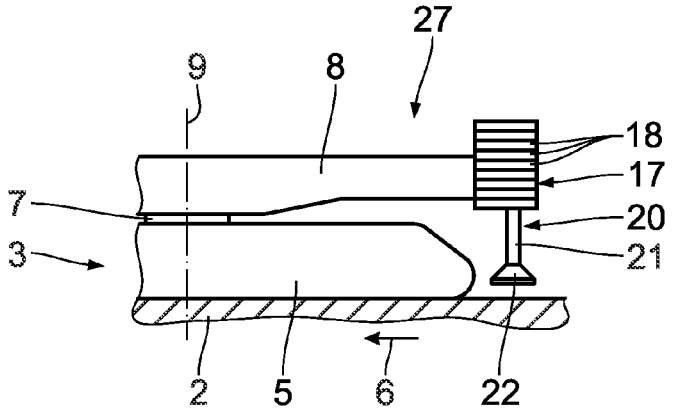
FIG. 6 shows a view of a crane according to FIG. 3 according to a further embodiment.
Figure 7:
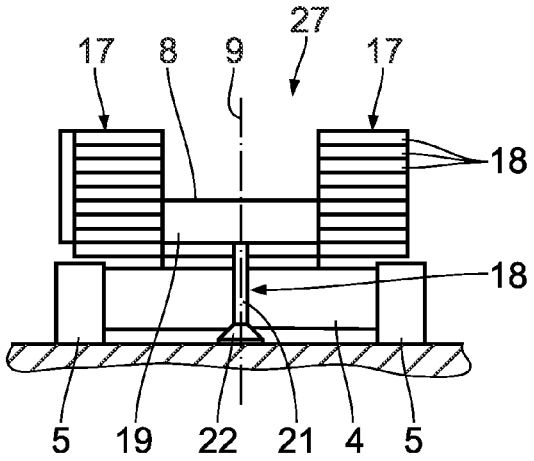
FIG. 7 shows a view from the rear of the crane in FIG. 6.

A further embodiment of the invention is illustrated in FIGS. 6 and 7. Components, which correspond to those which have already been explained above with reference to FIGS. 1 to 5, have the same reference numerals and are not discussed again in detail.

An essential difference of the crane 27 according to the preceding embodiments is that the support unit 20 is already supported on the ground 2 in the unloaded state according to FIG. 6. The support effect takes place directly.

Figure 8:
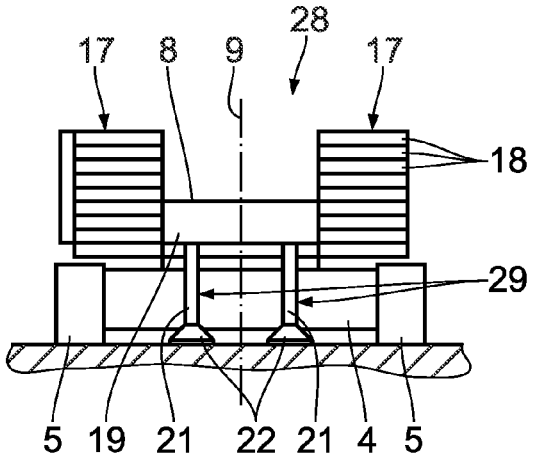
FIG. 8 shows a view of a crane according to FIG. 7 according to a further embodiment.

A further embodiment of the invention is shown in FIG. 8. Components, which correspond to those which have already been explained above with reference to FIGS. 1 to 7, have the same reference numerals and are not discussed again in detail.

Crane 28 corresponds essentially to crane 27, wherein the support unit 29 is designed such that it comprises two support cylinders 21. The two support cylinders 21 of the support unit 29 are arranged symmetrically relative to the central plane, which includes the axis of rotation 9. The use of two support cylinders 21 enables greater lateral stability with a load which is oriented perpendicular to the central plane.

Figure 9:
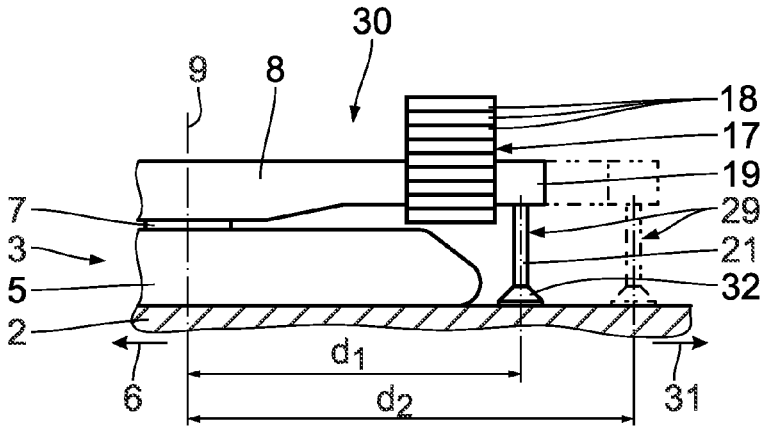
FIG. 9 shows a view of a crane according to FIG. 6 according to a further embodiment.
Figure 10:
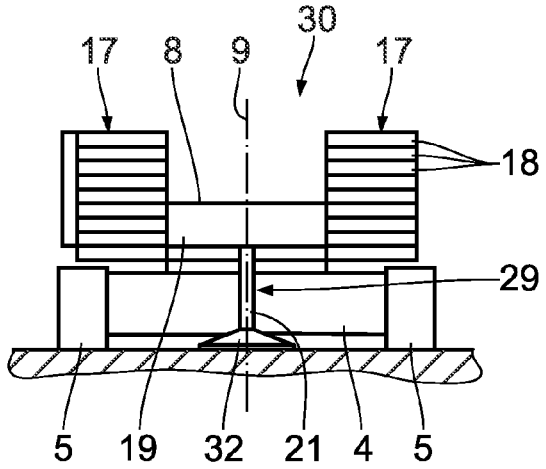
FIG. 10 shows a view from the rear of the crane according to FIG. 9.

A further embodiment of the invention is shown in FIGS. 9 and 10. Components, which correspond to those which have already been explained above with reference to FIGS. 1 to 8, have the same reference numerals and are not discussed again in detail.

The crane 30 corresponds essentially to the crane 1 according to FIG. 1. The essential difference is that the intermediate element 19 is designed to be varied in length in a length adjusting direction. According to the shown embodiment the length adjusting direction 31 is oriented opposite the direction of travel 6. The length adjusting device 31 is oriented in particular parallel to the ground 2 and in particular horizontally. To adjust the length of the intermediate element 19 a not shown telescopic cylinder can be provided.

The new tilting edge 26 is positioned in particular by determining the vertical distance D between the lower side of the support plate 22 and the ground 2 and/or the horizontal distance d of the support unit 20 from the axis of rotation 9.

According to the length adjustable embodiment of the intermediate element 9 the horizontal distance d can be varied. For example, a minimum horizontal distance $d_1$ and a maximum horizontal distance $d_2$ are possible. In particular, intermediate distances can be adjusted variably continuously.

A further difference according to the preceding embodiments is that on the lower side of the support cylinder 21 a support runner 32 is provided. The support runner 32 can be designed to be identical to the support plate 12 in side view 9. In the view of the crane 30 from the rear according to FIG. 10 it is clear that the support runner 32 has a greater width than the support plate 22.

Figure 11:
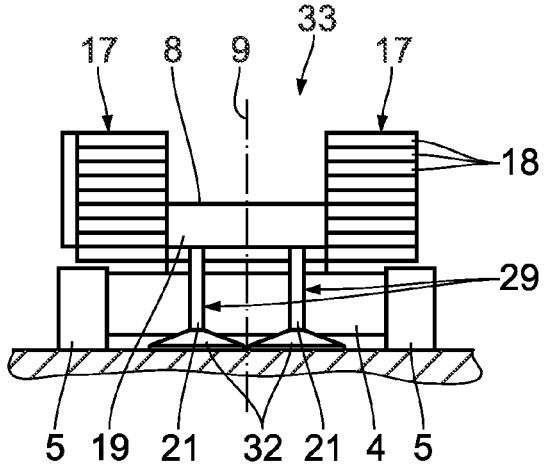
FIG. 11 shows a view of a crane according to FIG. 10 according to a further embodiment.

A further embodiment of invention is shown in FIG. 11. Components, which correspond to those already explained above with reference to FIGS. 1 to 10 have the same reference numerals and are not explained again in detail.

The only difference according to the crane shown in FIG. 10 is that the crane 33 comprises a support unit 29 with two support cylinders 21, on the lower side of which a support runner 32 is provided respectively.

Figure 12:
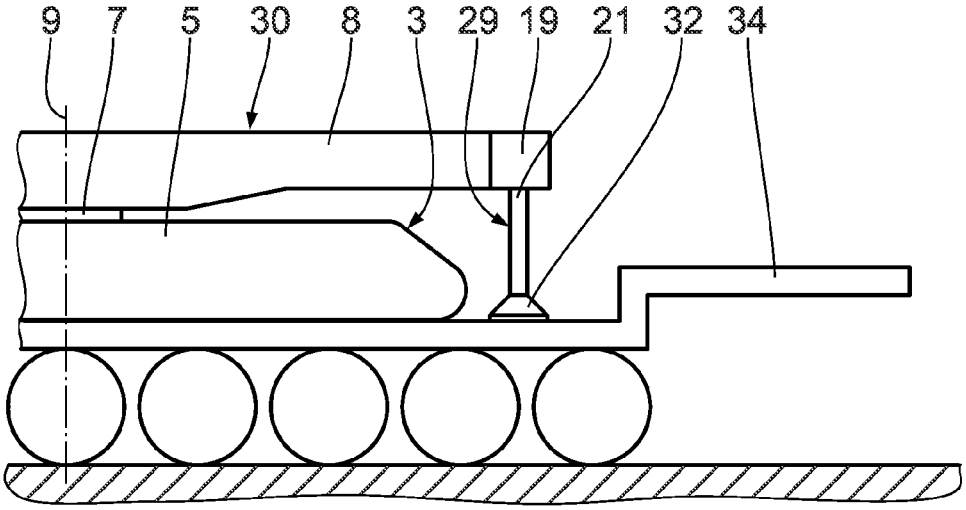
FIG. 12 shows a representation of the crane according to FIG. 9 in a transport arrangement on a low-loader.

FIG. 12 shows a transport arrangement of the crane 30 according to FIGS. 9 and 10. The crane 30 is in a transport position, i.e. the upper carriage counterweight 17 is removed. Likewise the jib is removed. The crane 30 is arranged on a low-loader 34. The support unit 20 is used for supporting the crane 30, in particular the upper carriage 8, on the low-loader 34. The crane 30 is located in a secure, reliable transport arrangement. The unintentional detachment of the transport arrangement is prevented. Of course, it is also possible to use a support plate 22 for supporting the upper carriage 8 on the low-loader 34 instead of the support runner 32.

Figure 13:
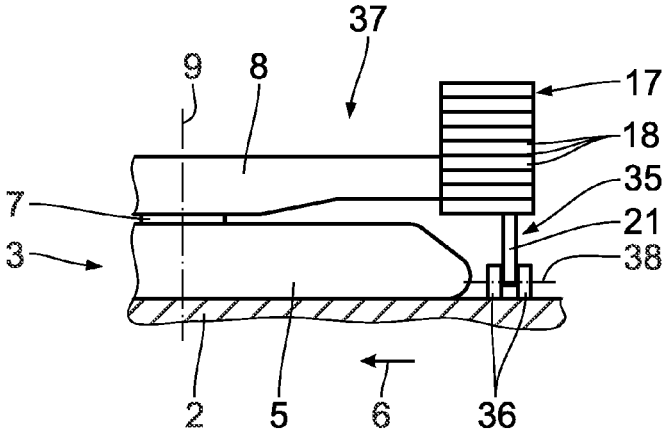
FIG. 13 shows representation of a crane according to FIG. 9 according to a further embodiment.
Figure 14:
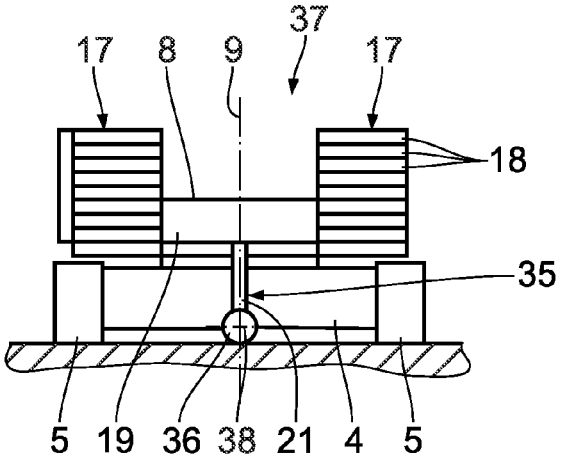
FIG. 14 shows a view from the rear of the crane according to FIG. 13.

A further embodiment of the invention is shown in FIGS. 13 and 14. Components, which correspond to those that have already been explained above with reference to FIGS. 1 to 12 have the same reference numerals and are not discussed again in detail.

The main difference from the above embodiments is that the support unit 35 comprises a displacement element in the form of driven support wheels. It is also possible that the displacement element 36 does not have a drive, but is attached rotatably at least about a horizontal axis of rotation 38 on one end of the support cylinder 21 facing the ground. The displacement elements 36 enable the displacement and/or pivoting of the upper carriage 8 about the axis of rotation 9 relative to the undercarriage 3. A rotary movement of the upper carriage can be supported by driven support wheels.

The displacement elements 36 are attached rotatably relative to a longitudinal axis of the support cylinder 21. In the arrangement shown in FIG. 14, in which the displacement elements 36 are tangential to a circular path around the longitudinal axis 9 of the crane 37, a pivoting movement of the upper carriage 8 is also ensured with ground contact of the support unit 35.

In an additional arrangement not shown in FIG. 14, displacement elements 36, which are rotated by 90° about the vertical longitudinal axis of the support cylinder 21, are oriented parallel to the caterpillar chassis 5. In an arrangement of this kind the crane 37 can drive straight on and in particular in a supported manner.

Figure 15:
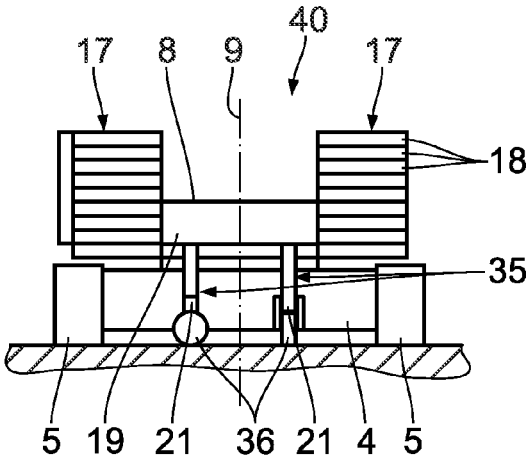
FIG. 15 shows a view of a crane according to FIG. 14 according to a further embodiment.

A further embodiment of the invention is shown in FIG. 15. Components, which correspond to those that have already been explained with reference to FIGS. 1 to 14, have the same reference numerals and are not discussed again in detail.

The main difference between crane 40 and crane 37 is that two support cylinders 21 are arranged with attached displacement elements 36.

According to the above explanations the displacement elements 36 are arranged rotatably on the support cylinders 21 about their respective longitudinal axis. Possible arrangements of the displacement elements 36 are shown by way of example in FIG. 15. The displacement elements 36 are designed to be flexible and enable the support of a driving and/or rotary movement of the crane 37.

Figure 16:
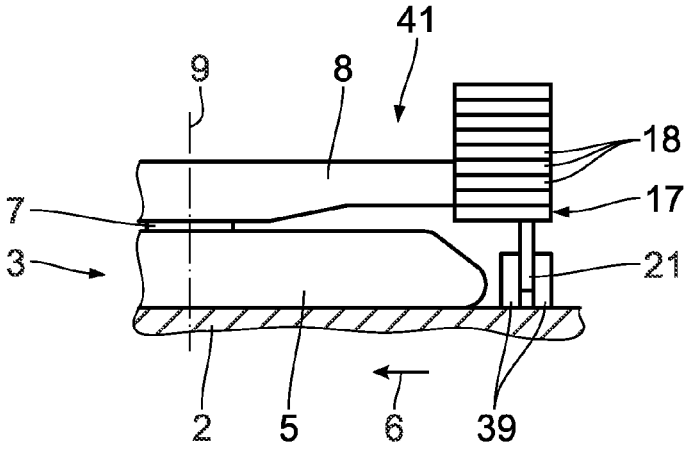
FIG. 16 shows a view of a crane according to FIG. 13 according to a further embodiment.
Figure 17:
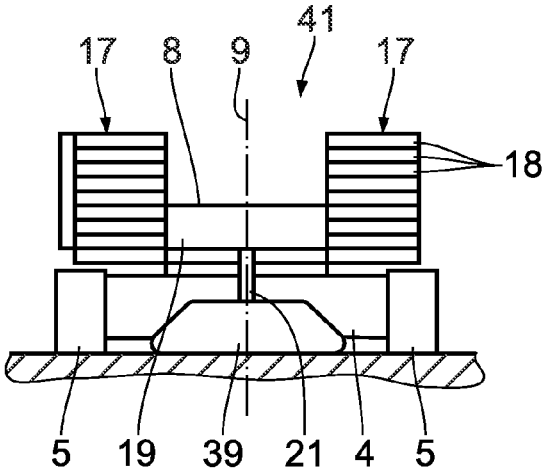
FIG. 17 shows a view from the rear of the crane according to FIG. 16.

A further embodiment of the invention is shown in FIGS. 16 and 17. Components, which correspond to those which have already been explained above with reference to FIGS. 1 to 15, have the same reference numerals and are not discussed again in detail.

The main difference of the crane 41 compared to the embodiment shown in FIGS. 13 and 14, is that the displacement elements are designed as drivable support caterpillars 39.

Figure 18:
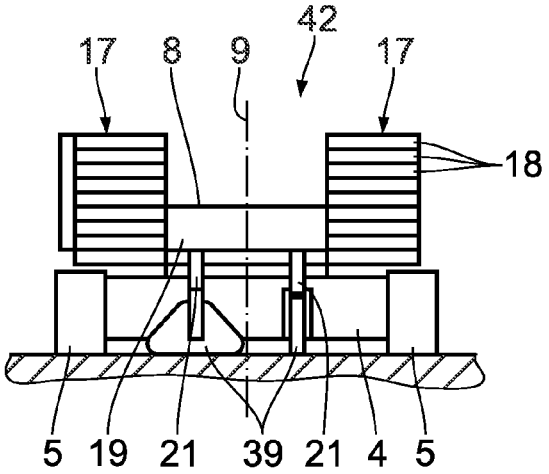
FIG. 18 shows a view of a crane according to FIG. 17 according to a further embodiment.

In a further embodiment of the crane 42 according to FIG. 18, in which two support cylinders are provided in the support unit, the support caterpillars 39 have a reduced length.

Figure 19:
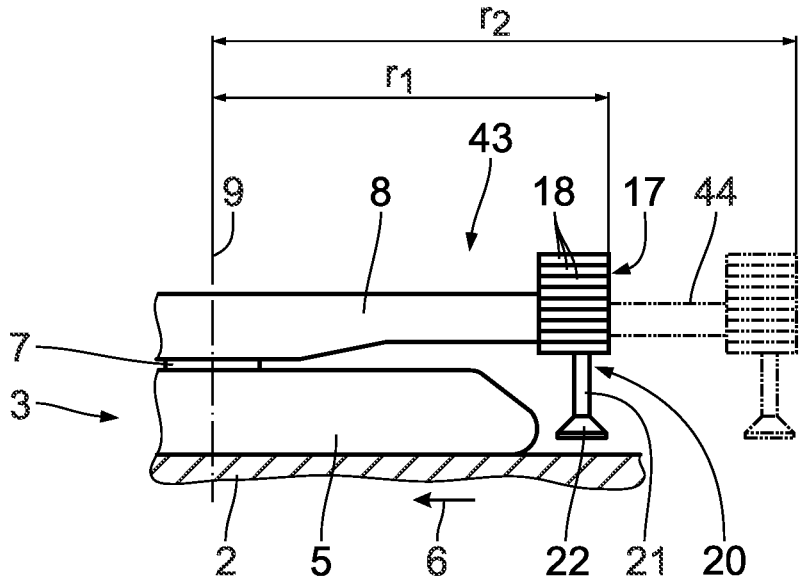
FIG. 19 shows a view of a crane according to FIG. 6 according to a further embodiment.

A further embodiment of the invention is represented in FIG. 19. Components, which correspond to those that have already been explained above with reference to FIGS. 1 to 18, have the same reference numerals and are not explained again in detail.

The main difference of crane 43 from the crane 27 represented in FIG. 6 is the displaceability of the upper carriage counterweight 17 in a radial direction relative to the axis of rotation 9. In FIG. 19 a first radial distance r1 is shown by solid lines. A potential second, radial distance r2, which is greater than the first radial distance r1, is shown by a dashed line. According to the shown example embodiment the radial displaceability of the upper carriage weight 17 is provided by means of a telescopic pipe 44, which is mounted telescopically in the upper carriage 8 of the crane 43. It is also possible that the upper carriage counterweight 17 is arranged displaceably on a separate slide on the upper carriage 8. The manner of the radial displacement is not important in this case. It is essential that by means of the displaceability of the upper carriage weight 17 the caused counter moment can be adjusted variably.

It is possible to combine the displaceability of the upper carriage counterweight 17 in particular with the length-adjustable embodiment of the intermediate element 19 of the crane 27 according to FIG. 6.

In this way the flexibility is increased on the influence on a possible adjustment of a counter moment.

What is claimed is:

1. A crane comprising a. an undercarriage (3), b. an upper carriage (8) arranged on the undercarriage (3), c. a rotary connection (7) for rotatably mounting the upper carriage (8) on the undercarriage (3) about an axis of rotation (9), d. a support unit (20; 29; 35) attached to the upper carriage (8) for increasing a distance (d) of a tilting edge (26) from the axis of rotation (9), e. a jib (10), which is arranged relative to the axis of rotation (9) of the support unit (20; 29; 35) opposite on the upper carriage (8), wherein the crane (1) has an increased structural stability and an increased load capacity, and wherein the upper carriage (8) is deformed by additional upper carriage counterweight (17) such that the support unit (20) is supported, via at least one height-adjusting support cylinder (21), on the ground (2).

2. A crane according to claim 1, wherein the support unit (20; 29; 35) comprises a support element.

3. A crane according to claim 1, wherein the support unit (20; 29; 35) comprises a support plate (22).

4. A crane according to claim 1, wherein the support unit (20; 29; 35) is secured directly to the upper carriage (8).

5. A crane according to claim 1, wherein the support unit (20; 29; 35) is secured onto the upper carriage (8) by an intermediate element (19).

6. A crane according to claim 5, wherein the intermediate element (19) is provided to be variable in length in a length adjusting direction (31).

7. A crane according to claim 1, wherein the support unit (20; 29; 35) comprises a displacement element (36; 39) for moving the support unit (20; 29; 35) along the ground (2).

8. A crane according to claim 1, wherein the support unit (20; 29; 35) is arrangeable on the upper carriage (8) able to be displaced between an operating position and a transport position.

9. A crane according to claim 1, wherein the support unit (20) is arranged in an unloaded state of the crane (1; 23) at a distance (D) from the ground (2).

10. A crane according to claim 9, comprising an external load which, when reached, lifts the support unit (20) from the ground (2).

11. A crane according to claim 10, wherein the external load is adjustable variably.

12. A crane according to claim 1, wherein the support unit (20) is arranged in an unloaded state of the crane (1; 23) at an adjustable distance (D) from the ground (2).

13. A crane according to claim 1, comprising an upper carriage counterweight (17).

14. A crane according to claim 13, wherein the upper carriage counterweight (17) is arranged along a direction of travel (6) between the axis of rotation (9) and the support unit (20; 29; 35).

15. A crane according to claim 13, wherein the upper carriage counterweight (17) is arranged displaceably in radial direction relative to the axis of rotation (9).

16. A crane according to claim 1, wherein the support unit (20; 29; 35) is integrated into the upper carriage (8).

* * * * *